US007082922B2

(12) United States Patent
Abe et al.

(10) Patent No.: US 7,082,922 B2
(45) Date of Patent: Aug. 1, 2006

(54) FUEL INJECTION METHOD OF INTERNAL COMBUSTION ENGINE, FUEL INJECTION VALVE OF THE SAME, AND INTERNAL COMBUSTION ENGINE

(75) Inventors: Motoyuki Abe, Chiyoda (JP); Noriyuki Maekawa, Chiyoda (JP); Takuya Shiraishi, Hitachinaka (JP); Hiroshi Fujii, Tokyo (JP); Mamoru Fujieda, Tomobe (JP); Toru Ishikawa, Kitaibaraki (JP); Yoshiyuki Tanabe, Hitachinaka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 93 days.

(21) Appl. No.: 10/962,753

(22) Filed: Oct. 13, 2004

(65) Prior Publication Data

US 2005/0109311 A1 May 26, 2005

(30) Foreign Application Priority Data

Oct. 14, 2003 (JP) ..... 2003-353563

(51) Int. Cl.
*F02B 15/00* (2006.01)

(52) U.S. Cl. ..... 123/305; 123/295; 123/123; 123/470

(58) Field of Classification Search ..... 123/295, 123/305, 470
See application file for complete search history.

(56) References Cited

U.S. PATENT DOCUMENTS

| | | | | |
|---|---|---|---|---|
| 4,721,081 | A * | 1/1988 | Krauja et al. | 123/298 |
| 5,058,549 | A * | 10/1991 | Hashimoto et al. | 123/298 |
| 6,227,164 | B1 * | 5/2001 | Miller | 123/295 |

FOREIGN PATENT DOCUMENTS

| | | |
|---|---|---|
| DE | 10007659 A1 | 9/2001 |
| EP | 1036933 A2 | 9/2000 |
| EP | 1191199 A1 | 3/2002 |
| EP | 1219826 A2 | 7/2002 |
| JP | 2002-195133 | 7/2002 |
| LU | 90599 | 12/2001 |

* cited by examiner

*Primary Examiner*—Erick R Solis
(74) *Attorney, Agent, or Firm*—Crowell & Moring LLP

(57) ABSTRACT

In order to provide a fuel injection method of an internal combustion engine having higher combustion stability which can direct a part of concentrated fuel spray toward an ignition plug according to a fuel injection atmosphere, a fuel injection valve thereof, and an internal combustion engine, the present invention provides a fuel injection method of an internal combustion engine for injecting fuel so as to generate a part of high spray concentration and a part of low spray concentration on the cross section of spray by giving swirling force to fuel from an injection hole at the front end of a fuel injection valve, comprising the step of setting a reference indicating the position of a axis of the fuel injection valve indicating the injection direction of the part of high spray concentration in the rotational direction when fuel is injected into an atmosphere under the atmospheric pressure.

20 Claims, 9 Drawing Sheets

(a)

(b)

(a)

(b)

(a)

(b)

(a)

(b)

FUEL INJECTION METHOD OF INTERNAL COMBUSTION ENGINE, FUEL INJECTION VALVE OF THE SAME, AND INTERNAL COMBUSTION ENGINE

BACKGROUND OF THE INVENTION

The present invention relates to a fuel injection method of a new internal combustion engine, a fuel injection valve thereof, and an internal combustion engine.

Patent Document 1 indicates a manufacturing method of a fuel injection valve, as a fuel injection valve used for a gasoline engine of a direct injection type, for adjusting a spray shape having a part of concentrated spray and a part of rarefied spray on the cross section of spray to a desired shape by providing a level difference on the opening face of the injection hole.

Patent Document 1: Japanese Patent Application 2002-195133

SUMMARY OF THE INVENTION

Patent Document 1 discloses that in spray injected from the fuel injection valve, a part of concentrated fuel spray and a part of rarefied fuel spray are formed and even when the pressure in the cylinder is high, fuel spray is stably supplied to the ignition plug side.

However, the inventors find that when a part of concentrated fuel spray and a part of rarefied fuel spray are provided in spray of the fuel injection valve for rotating fuel to make it small in size, fuel flows out during rotation, thus even in the atmosphere wherein fuel is injected, a rotating gas current is generated, so that a phenomenon occurs that depending on the density of the atmosphere, the part of concentrated fuel spray rotates in the rotational direction of the axis of the fuel injection valve.

Therefore, when rotating fuel and injecting it from the injection valve, the fuel injection valve is attached to an internal combustion engine of a direct injection type and when the fuel injection valve is used under the condition that the fuel injection time is in the compression stroke, the combustion chamber pressure is higher than the atmospheric pressure, so that under the condition that a part of concentrated fuel spray is generated at the position when it rotates more than a case that fuel is injected into the atmosphere of air pressure, the fuel injection valve is used.

Therefore, the inventors find that even if the fuel injection valve is attached to the internal combustion engine so that the part of concentrated fuel spray in the atmosphere of air pressure moves toward the ignition plug, when fuel is injected in the compression stroke, the part of concentrated fuel spray is generated at a position shifted from the ignition plug in the combustion rotational direction and the fuel injection valve is not always used at a position of most suitable combustion stability.

An object of the present invention is to provide a fuel injection method of an internal combustion engine of higher combustion stability, a fuel injection valve thereof, and an internal combustion engine capable of moving the part of concentrated fuel spray toward the ignition plug depending on the injection atmosphere.

The present invention is characterized in that in a fuel injection method for an internal combustion engine loading a fuel injection valve for injecting fuel from an injection hole so that a part of high spray concentration and a part of low spray concentration are generated by giving swirl force to the fuel on the upstream side of the injection hole for injecting the fuel, the fuel injection valve is mounted so that the position where the fuel is rotated in the rotational direction is moved toward the ignition plug from the part of high spray concentration generated by the injection under the atmospheric pressure.

Concretely, the present invention is characterized in that in a fuel injection method of an internal combustion engine for injecting fuel so that a part of high spray concentration and a part of low spray concentration are generated on the cross section of spray by giving swirl force to the fuel from an injection hole at the front end of a fuel injection valve, a reference indicating the position in the rotational direction of the axis of the fuel injection valve indicating the injection direction of the part of high spray concentration when the fuel is injected into the atmosphere under the atmospheric pressure is set.

According to the present invention, it is preferable to set the reference of the position in the rotational direction so that the part of high spray concentration under pressure higher than the atmospheric pressure is directed toward the ignition plug, to set the reference indicating the position in the rotational direction at the position when the injection direction of the part of high spray concentration under the atmospheric pressure is rotated in the opposite direction of the rotation direction of the axis of the fuel injection valve instead of the position of the ignition plug, and to set the rotation amount of the axis of the fuel injection valve indicating the injection direction in which the part of high spray concentration under pressure higher than the atmospheric pressure moves toward the ignition plug, on the basis of at least one operation condition relating to engine speed of the internal combustion engine, load, exhaust gas recirculation amount, and fuel injection time and with reference to the rotation amount indicating the injection direction of the part of high spray concentration under the atmospheric pressure, in the opposite direction of the rotational direction.

The spray under the atmospheric pressure preferably has a cross section in a hollow conical shape and the spray under the atmospheric pressure preferably has a cross section in a hollow conical shape eccentric to the central axis of the injection hole.

Further, the present invention is characterized in that in a fuel injection valve of an internal combustion engine including a fuel injection valve having an injection hole for injecting fuel and a swirl force giving means for giving swirl force to the fuel for injecting the fuel from the injection hole so as to generate a part of high spray concentration and a part of low spray concentration under the atmospheric pressure, the fuel injection valve has a positioning means indicating the position of the axis of the fuel injection valve attached to the internal combustion engine in the rotational direction and the positioning means, so as to position the part of high spray concentration in the injection direction under the atmospheric pressure, is a set position with reference to the position of the part of high spray concentration under the atmospheric pressure in the rotational direction of the axis of the fuel injection valve in the injection direction.

It is preferable to set the injection direction of the part of high spray concentration under the atmospheric pressure at the position when it rotates in the opposite direction of the rotational direction of the axis of the fuel injection valve instead of the position of the ignition plug, thereby to set the reference of the position in the rotational direction so that the part of high spray concentration under pressure higher than the atmospheric pressure is directed toward the ignition plug and furthermore, to set the rotation amount of the axis of the fuel injection valve indicating the injection direction in which the part of high spray concentration under pressure higher than the atmospheric pressure moves toward the ignition plug, on the basis of at least one operation condition relating to the engine speed of the internal combustion engine, load, exhaust gas recirculation amount, and fuel injection time and with reference to the rotation amount indicating the injection direction of the part of high spray concentration under the atmospheric pressure, in the opposite direction of the rotational direction.

The positioning means is preferably a mark or a pin for the aforementioned positioning and it is preferably to change the length of the pin, thereby to set the aforementioned rotation amount.

Furthermore, the present invention is characterized in that in an internal combustion engine including a fuel injection valve having an injection hole for injecting fuel and a swirl force giving means for giving swirl force to the fuel and loading a fuel injection valve for injecting the fuel from the injection hole so as to generate a part of high spray concentration and a part of low spray concentration under the atmospheric pressure, the fuel injection valve and internal combustion engine respectively have a positioning means indicating the mounting position and the positioning means between the fuel injection valve and the internal combustion engine is set as a reference indicating the position of the axis of the fuel injection valve indicating the injection direction of the part of high spray concentration under the atmospheric pressure in the rotational direction. Further, the fuel injecting valve is preferably composed of the aforementioned fuel injection valve.

According to the present invention, a fuel injection method of an internal combustion engine having higher combustion stability which can direct a part of concentrated fuel spray toward an ignition plug, a fuel injection valve thereof, and an internal combustion engine can be provided and most appropriate spray can be obtained from an direct injection engine.

DETAILED DESCRIPTION OF THE PREFERRED EMBODIMENT

Figure 1:
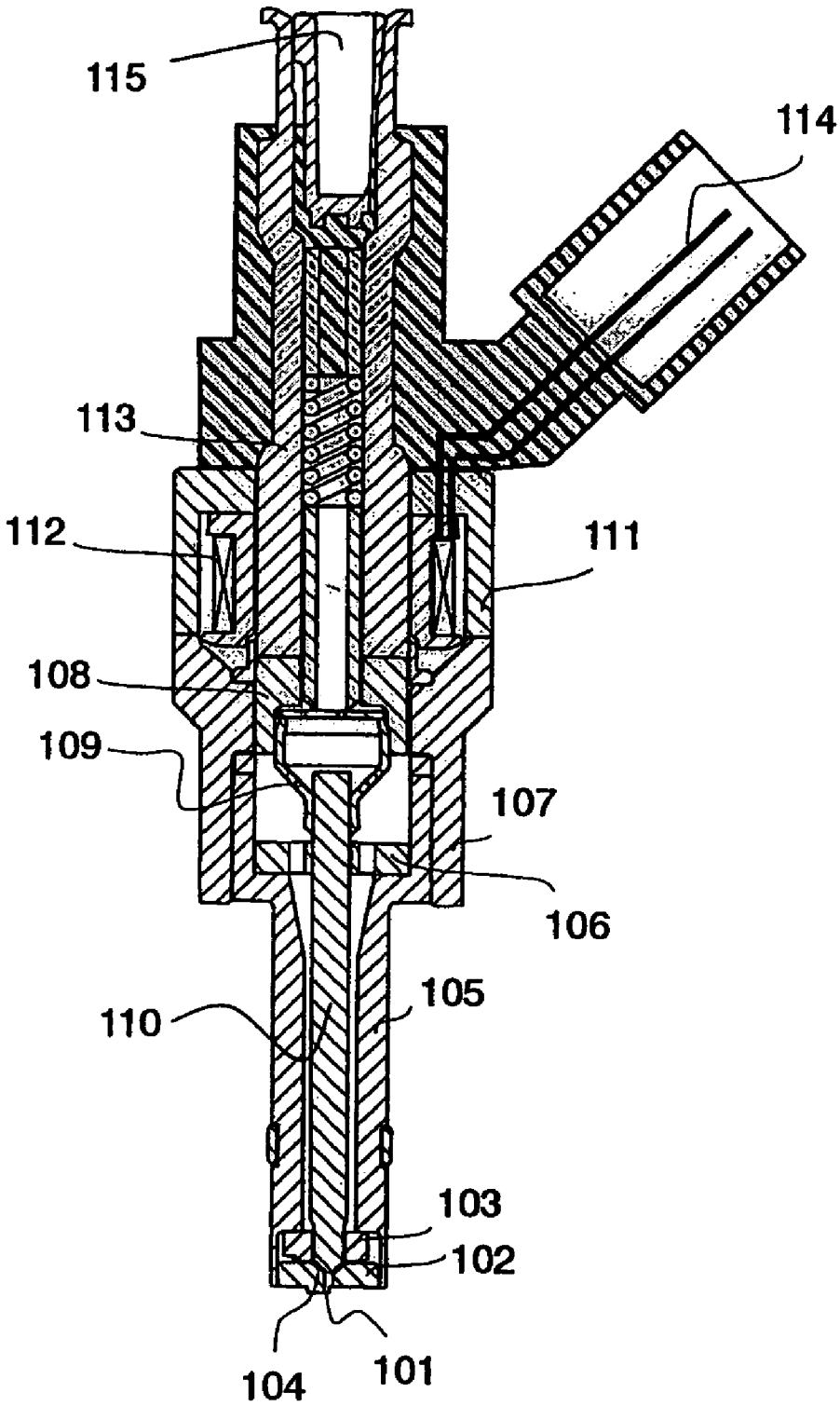
FIG. 1 is a cross sectional view of the fuel injection valve relating to the present invention.

FIG. 1 is a cross sectional view showing the structure of an embodiment of the fuel injection valve relating to the present invention. The fuel injection valve shown in FIG. 1 is an electromagnetic fuel injection valve of a closed type at normal time and when no current is supplied to a coil 112, a valve body (a plunger rod) 110 and a valve seat 104 are adhered closely to each other. Fuel, in a state that pressure is given by a fuel pump not drawn, is fed from a fuel feed port and the interval from a fuel path 115 to the adhered position of the valve body 110 and the valve seat 104 is filled with fuel. When a voltage is applied to the coil 112 from a connector 114, magnetic force passing a core 113 and an anchor 108 is generated and the valve body 110 connected by the anchor 108 and a joint pipe 109 is displaced. At this time, when the valve body 110 is separated from the valve seat 104 due to displacement, fuel is injected from an injection hole 101. Then, the fuel reaches the injection hole 101 through a rotation groove formed in a swirl element 103 and when passing the rotation groove of the swirl element 103, the fuel is given swirling force and is rotated and injected from the injection hole 101. An injection valve for rotating and flowing out fuel from the injection hole by the means for generating the swirling force in fuel like this is hereinafter referred to as a swirl type fuel injection valve. Further, the means for giving the swirling force to fuel does not need to be a swirl element and a groove-shaped flow path formed in the valve body or a flow path through which fuel passes may be installed so as to rotate the fuel.

Figure 2:
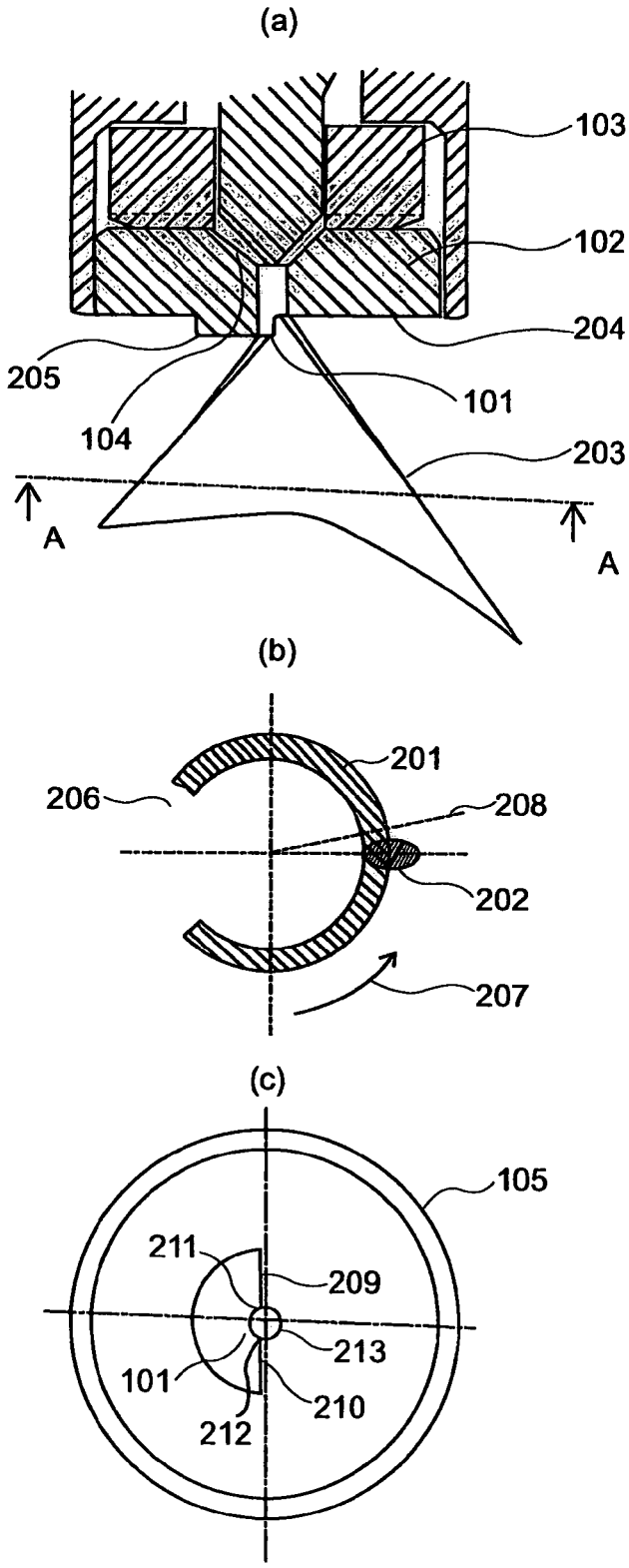
FIG. 2(*a*) is a cross sectional view of the enlarged neighborhood of the injection hole of the fuel injection valve relating to the present invention, and FIG. 2(*b*) is a cross sectional view showing the spray state of fuel injected from the fuel injection valve, and FIG. 2(*c*) is a plan view of the fuel injection valve viewed from underneath.

FIG. 2(*a*) is a cross sectional view of the enlarged neighborhood of the valve seat 104 and the injection hole 101 of the fuel injection valve shown in FIG. 1. In the fuel injection valve shown in FIG. 2(*a*), end faces 204 and 205 have a level difference in the injection hole 101 and spray 203 formed, on the side of the end face 204 on the side of the injection hole 101 which is shorter, becomes spray having strong penetration. As shown in FIG. 2(*b*), the section A—A (the cross sectional view) of the spray 203 has a horseshoe shape.

The horseshoe-shaped spray is in a spray shape having a concentrated part 202 of high-concentration spray and a lean part 206 of low-concentration spray in a part of a hollow conical spray in the spray shape injected from a general swirl type injection valve. Further, the cross sectional view shown in FIG. 2(*b*) is a drawing of spray viewed from the downstream side of the fuel injection valve and a combustion rotational direction 207 is the direction of the arrow.

Figure 3A:
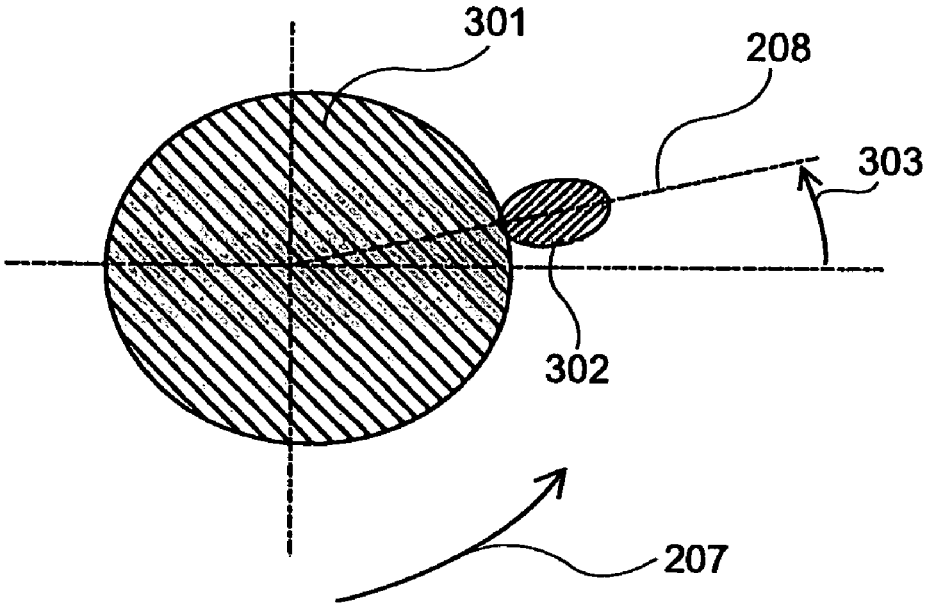
FIG. 3 is a cross sectional view showing the spray state when fuel is injected into an atmosphere under a pressure higher than the atmospheric pressure in the fuel injection valve shown in FIG. 2.
Figure 3B:
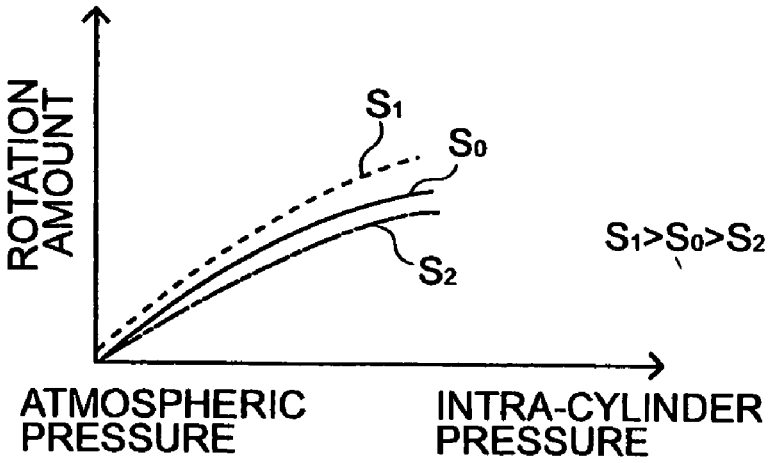

The horseshoe shape of spray shown in the cross sectional view in FIG. 2(*b*) is the spray shape when fuel is injected into air under the atmospheric pressure. The shape of spray is affected by the density and pressure of the atmosphere. For example, when fuel is injected into an atmosphere whose pressure is raised and whose concentration is increased, the spray shape shown in the cross sectional view in FIG. 2(*b*) is changed to a shape as shown in FIG. 3(*a*). In the hollow conical spray 201, by air flow entering the hollow portion under low pressure, the shape is shrinks toward the center of spray 301. Further, the spray concentrated part 202, since spray is concentrated, is hardly affected by the air flow, so that the shape is comparatively kept.

However, in the rotation type fuel injection valve, fuel flows out with swirl motion, so that the flow of ambient gas also rotates in the same direction. Therefore, the spray concentrated part 202 is also affected by the air flow and is slightly rotated in a rotational direction 303 of the concentrated part shown by the arrow. The rotational direction 303 is the same as the rotational direction 207 of fuel flow. Further, the degree of rotation varies with the density of ambient gas, so that when the pressure of ambient gas is changed, the rotation amount indicating the degree of rotation is also changed, thus as the pressure and density are increased, the rotation amount is increased.

When such spray is used for an internal combustion engine of a direct injection type, if the spray concentrated part 202 is directed toward the ignition plug, the air-fuel ratio around the ignition plug can be stably increased, so that the ignitablity can be improved, and an miss fire can be prevented, and the combustion stability can be improved. Particularly, when executing stratified combustion, an effect of improving the combustion stability can be produced.

The stratified combustion is a method that mixed gas in the combustion chamber has a concentrated part and a rarefied part, and a part of a high combustible air-fuel ratio is formed in the neighborhood of the ignition plug, thus as a whole, combustion using mixed gas of a high air-fuel ratio (that is, rarefied fuel) is executed.

When executing the stratified combustion, fuel is injected in the compression stroke, so that injection is executed under the condition that the pressure of air in the combustion chamber is high. Namely, in a state that the spray concentrated part 302 to be directed toward the ignition plug is rotated in the combustion rotation direction for the spray concentrated part 202 under the atmospheric pressure, the stratified combustion is executed.

Therefore, to improve the combustion stability, as mentioned above, in consideration of that the spray concentrated part is rotated under a high pressure, the fuel injection valve is attached to the internal combustion engine. Namely, for the direction of a spray concentrated part 202 generated when the spray concentrated part 302 generated under a high pressure is injected into ambient gas under the atmospheric pressure, in the rotational direction 207 of the fuel flow, the fuel injection valve is mounted in the direction 208 of the ignition plug in the rotational direction 303 of the spray concentrated part. In other words, the fuel injection valve is attached to the internal combustion engine so that the spray concentrated part 202 generated when fuel is injected into the ambient gas under the atmospheric pressure is directed toward the position of an ignition plug 403, while the fuel injection valve itself, when fuel is injected under the condition that the pressure of ambient gas injected in the compression stroke is high, is mounted at the position when it is rotated in the opposite direction of the combustion rotational direction.

FIG. 2(*c*) is a plan view of the injection hole 101 of the fuel injection valve shown in FIG. 1 which is viewed from underneath. In FIG. 2(*c*), the end face 205 which is the top of the step formed in parallel with the plane perpendicular to the central axis of the injection hole and the end face 204 which is the bottom of the step are formed and the end face 205 is installed on the downstream side of the end face 204 in the fuel flow direction. Wall faces 209 and 210 are almost parallel with the central axis of the injection hole and there is a level difference face installed so as to join the end faces 205 and 204 in the direction of the central axis of the injection hole.

Further, a rotation restriction wall face is installed in the rotational direction of the fuel flow so as to be almost parallel with the central axis of the injection hole. The rotation restriction wall face is installed on the circular arc of the almost concentric circle with the inner wall of the injection hole so as to restrict the motion of fuel in the radial direction. Fuel flowing while rotating flows out while rotating along the rotation restriction wall face.

The rotation restriction wall face is joined to the wall faces 209 and 210 outward restriction wall face ends 211 and 212 in the radial direction of the injection hole and acts as a movement restriction wall face for restricting the motion of injected fuel in the moving direction.

The restriction wall face is installed in a part of the range of the injection hole in the peripheral direction and a function as a restriction wall face along the rotation of fuel is provided between the restriction wall face ends 211 and 212. Among the restriction wall face ends, the restriction wall face end 211, when the position thereof is viewed as a reference, is arranged at the position when the end face 205 is arranged on the downstream side (the end face 204 is arranged on the upstream side in the rotational direction 207) of the rotational direction 207. Further, the restriction wall face end 212 is arranged at the position when the end face 205 is arranged on the upstream side (the end face 205 is arranged on the downstream side in the rotational direction 207) of the rotational direction 207. Further, in the example shown in FIG. 2(*c*), the restriction wall face, in the front view, is installed so as to almost coincide with an inner wall 213 of the injection hole. Therefore, the restriction wall face can be regarded as a part of the injection inner wall.

The restriction wall face end 211 is an upstream side restriction wall face end and the restriction wall face end 212 is a downstream side restriction wall face end. The shape of spray injected from the fuel injection valve in which the opening of the injection hole 101 is formed like this, as shown in FIG. 2(*b*), so that spray in a biased hollow conical shape is obtained and the hollow conical spray 201 composed of the spray concentrated part 202 of the part of high spray concentration and the part of rarefied spray concentration is also generated, can be adjusted by the position relationship of the end faces 209 and 210 formed outward the injection hole 101 from the restriction wall face ends 211 and 212.

FIG. 3(*b*) is a diagram showing the relationship between the rotation amount of the spray concentrated part, which is the part of high spray concentration, to the swirl force and the combustion chamber pressure. The rotation amount indicates the angle in the rotational direction 303 and swirl force $S_1$ larger than reference swirl force $S_0$ and swirl force $S_2$ smaller than it have a relationship as shown in FIG. 3(*c*). As the combustion chamber pressure is increased or the swirl force is increased, the rotation amount of the spray concentrated part which is the part of high spray concentration is increased. Therefore, according to the rotation amount, the rotation position of the fuel injection valve can be set.

Figure 4:
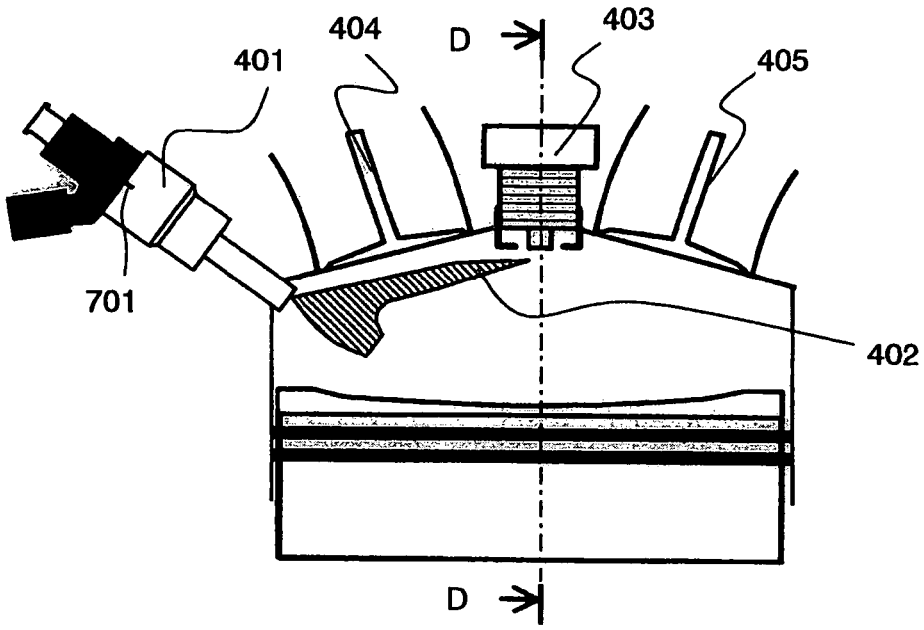
FIG. 4(*a*) is a cross sectional view when the fuel injection valve relating to the present invention is loaded on an internal combustion engine and FIG. 4(*b*) is a cross sectional view showing the fuel spray state.
Figure 4:
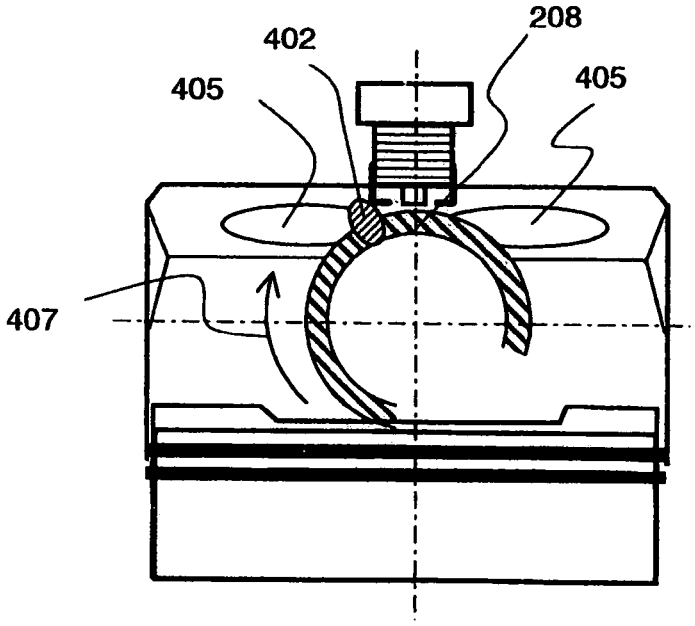

FIG. 4(*a*) is a cross sectional view showing a structure example of the fuel injection valve attached to an internal combustion engine of an combustion chamber direct injection type and FIG. 4(*b*) is a cross sectional view of the section D—D shown in FIG. 4(*a*). A fuel injection valve 401 is mounted on the side of a suction valve 404 so that the spray concentrated part 402 moves toward the ignition plug 403. Further, in the cross sectional view (b) of D—D, the fuel spray state is drawn in the cross sectional view of the internal combustion engine. The cross sectional view (b) of D—D is a drawing viewed from the side of the fuel injection valve and the viewing direction thereof is opposite to that of the cross sectional view of spray shown in FIG. 2(*b*).

Here, a spray concentrated part 402' is mounted by adjusting the mounting position of the fuel injection hole 401 so that it is arranged at the position when it rotates in the opposite direction of a combustion rotational direction 406. Namely, when fuel is injected into an ambience under a high pressure, the fuel injection valve is mounted at the position in the opposite direction of the combustion rotational direction 406 toward the ignition plug 403 from the position 208 where a spray concentrated part under the atmospheric pressure is generated.

When fuel is injected under a high atmospheric pressure, by this mounting, which is the actual use state, the spray concentrated part 402' rotates in the rotational direction 406 and is correctly directed toward the electrode of the ignition plug 403. In the actual use state, when the spray concentrated part 402' is correctly directed toward the electrode of the ignition plug 403, the concentration of fuel around the electrode is apt to increase, and the ignitability can be improved, and the combustion stability can be enhanced.

The combustion chamber pressure of the internal combustion engine changes depending on the operation conditions such as the engine speed, load, and EGR (exhaust gas recirculation) amount of the engine and the fuel injection time, so that the aforementioned rotation amount of the spray concentrated part is also changed depending on the operation conditions of the internal combustion engine. Therefore, the rotation amount when the fuel injection valve is mounted is adjusted to the rotation amount at which the combustion stability is to be most improved among the operation conditions.

Generally, it is desirable to direct a fuel concentrated part rotated under the conditions of low engine speed and a small fuel injection amount such as idling toward the ignition plug. When the engine speed is low, compared with a case of fast engine speed, the timing of fuel injection approaches the top dead center, so that the combustion chamber pressure is easily increased. Particularly, when the EGR is performed, the combustion chamber pressure is increased. Further, the load is small, thus the fuel injection amount is reduced, and the fuel amount around the ignition plug is reduced, so that it is a condition under which the combustion stability can be hardly ensured.

Under such a condition under which the fuel stability cannot be hardly ensured, in consideration of the aforementioned rotation of the spray concentrated part, the fuel injection valve is mounted. Namely, under the idling conditions (the combustion chamber pressure and density of ambient gas at the time of fuel injection), when the mounting rotation amount of the fuel injection valve is adjusted so that the spray concentrated part is directed toward the ignition plug, the combustion stability during idling can be improved.

In a general internal combustion engine of a combustion chamber direct injection type for an automobile, the rotation amount of the spray concentrated part under the idling conditions (for example, 550 rpm, an air-fuel ratio of 40, an EGR rate of 60%, 40° BTDC at the time of fuel injection) is set by shifting by 5 to 15° in the opposite direction of the combustion rotational direction for a case that fuel is injected into ambient gas under the atmospheric pressure. Therefore, the fuel injection valve, compared with the case that it is mounted so that the spray concentrated part when fuel is injected into an ambient gas under the atmospheric pressure is directed toward the ignition plug, is rotated and mounted in the opposite direction of the combustion rotational direction shifted by 5 to 15°.

Further, particularly when increasing the EGR amount and performing the idling or when delaying the fuel injection time and performing the operation, the combustion chamber pressure is increased more than it, so that the mounting rotation amount of the fuel injection valve is also increased.

Inversely, when improving the combustion stability in the partial load area more than that at the time of idling, a mounting rotation amount of the fuel injection valve smaller than it may be used. The reason is that in the partial load area, the engine speed is higher than that at the time of idling, so that the fuel injection time viewed by the crank angle is earlier than that at the time of idling, thus fuel is injected when the combustion chamber pressure is low, and the rotation amount of the spray concentrated part is also used in a small state.

By adjusting the mounting rotation amount of the fuel injection valve like this so as to direct the spray concentrated part under the use conditions in which the combustion stability is to be improved toward the ignition plug, the combustion stability under the use conditions can be improved. However, when improving the combustion stability under wider use conditions, it is desirable to mount an actuator for changing the mounting rotation amount of the fuel injection valve and internal combustion engine. It is desirable to adjust the mounting rotation amount of the fuel injection valve according to the use conditions (the engine speed, load, EGR rate) of the internal combustion engine by the actuator and direct the spray concentrated part toward the ignition plug.

When the combustion stability is enhanced as mentioned above, the performance (for example, fuel consumption, output, exhaust) of the internal combustion engine of an combustion chamber direct injection type can be improved. It is known that the performance of the internal combustion engine varies with the fuel injection time and ignition time. However, when the combustion stability is enhanced, the fuel injection time and ignition time realizing stable combustion can be spread in the range. Therefore, an injection time and an ignition time realizing lower fuel consumption, higher output, and less exhaust can be selected. By doing this, the performance of the internal combustion engine of a direct injection type can be improved.

Further, according to the mounting method of the fuel injection valve of the present invention, when operating the internal combustion engine of a combustion chamber direct injection type by homogeneous combustion, an effect of reducing smoldering or wetting of the ignition plug can be obtained. Under the operation condition that fuel is injected in the intake stroke of the homogeneous operation, the ambient pressure when fuel is injected is low. Under such a condition, compared with a case of compression stroke injection under a high ambient pressure, the penetration of the spray concentrated part 402' is strong and during the period before ignition, spray reaches far away from the injection point. Therefore, in a case of the operation by homogeneous combustion, fuel easily collides with the ignition plug, and liquid fuel is adhered to the ignition plug, and the resistance between the electrodes of the ignition plug is reduced, and smoldering of giving out no sparks is easily generated. According to the mounting method of the fuel injection valve of the present invention, similarly to the case of the operation by homogeneous combustion, under the condition of injection in the intake stroke, the spray concentrated part 402' is mounted so as to avoid the ignition plug 403, so that the fuel amount adhered to the ignition plug 403 can be suppressed and an occurrence of smoldering of the ignition plug can be suppressed.

The effects of the present invention are not limited to a case that as shown in FIG. 2, the fuel injection valve formed so that the end faces 204 and 205 have a level difference in the injection hole 101 is used. If a fuel injection valve generates a high concentration and a low concentration of injected spray, the effects of the present invention can be obtained.

Figure 5:
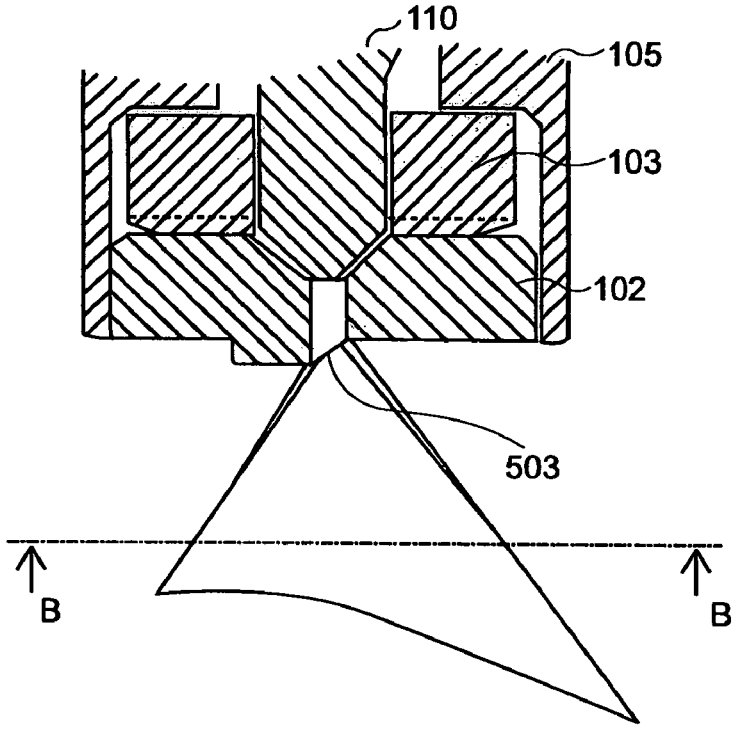
FIG. 5(*a*) is a cross sectional view of the enlarged neighborhood of the injection hole of the fuel injection valve relating to the present invention and FIG. 5(*b*) is a cross sectional view showing the spray state of fuel injected from the fuel injection valve.
Figure 5:
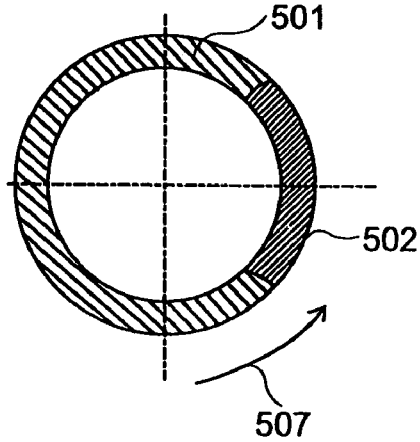

FIG. 5 is a cross sectional view of a fuel injection valve in which the opening of an injection hole 503 is formed by a slope. The fuel injection valve shown in FIG. 5 is a rotation type fuel injection valve through which fuel flows out while rotating. The fuel injection valve shown in FIG. 5 is a fuel injection valve in which the opening of the injection hole 503 is formed by a slope and the spray shape is as shown by the section B—B (the cross sectional view) shown in FIG. 5. The opening of the injection hole 503 is formed by a slope and in the cross section of injected spray, hollow conical spray 501 and a crescent spray concentrated part 502 having a higher spray concentration than it are formed. Even when the fuel injection valve as shown in FIG. 5 is used in the internal combustion engine of an combustion chamber direct injection type, to improve the combustion stability, the spray concentrated part 502 is desirably directed toward the ignition plug.

Figure 6:
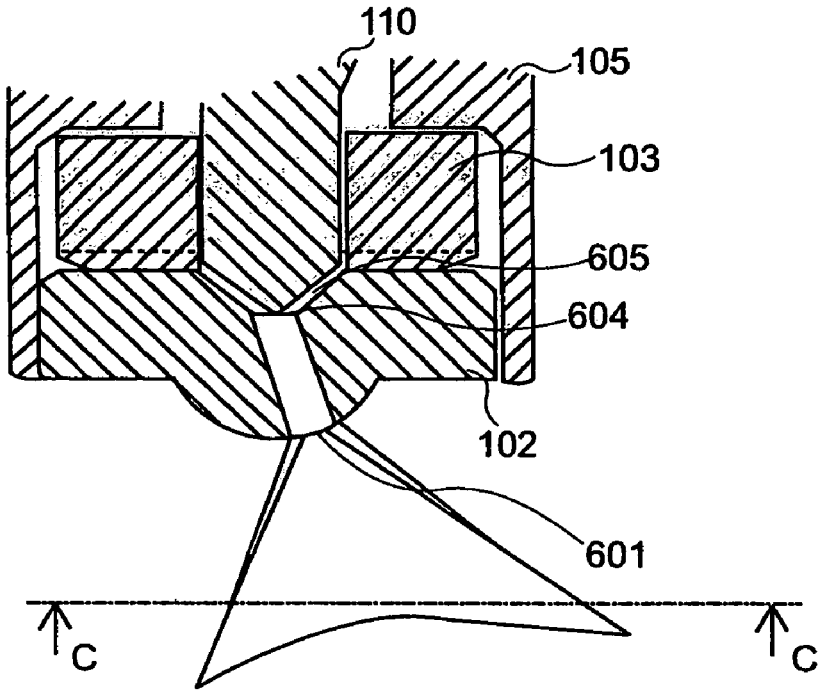
FIG. 6(*a*) is a cross sectional view of the enlarged neighborhood of the injection hole of the fuel injection valve relating to the present invention and FIG. 6(*b*) is a cross sectional view showing the spray state of fuel injected from the fuel injection valve.
Figure 6:
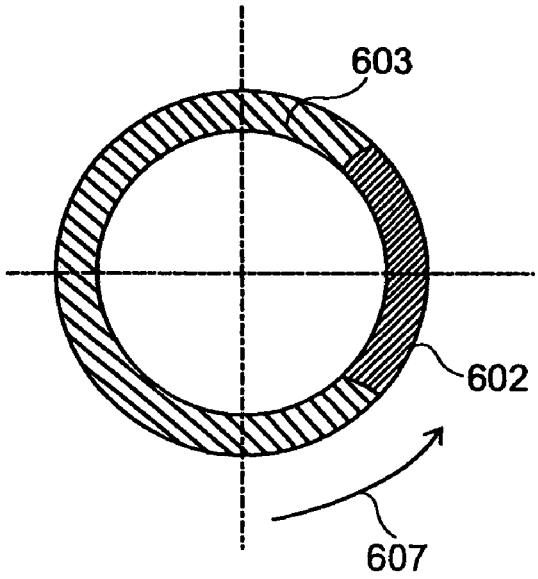

FIG. 6 is a cross sectional view of the fuel injection valve showing an example when an injection hole 601 is installed with a slope to the axis of the fuel injection valve. The fuel injection valve shown in FIG. 6 is a rotation type fuel injection valve through which fuel flows out while rotating. When the inclined injection hole 601 as shown in FIG. 6 is installed, at the position of a connected part 604 of a swirl chamber 605 and the injection hole 601, fuel becomes non-uniform in the swirling force and is injected from the injection hole 601, so that the formed spray, as the C—C cross sectional view shown in FIG. 6(*a*), generates a crescent spray concentrated part 602 concentrated more than a hollow conical spray 603 (FIG. 6(*b*)). In FIG. 6(*b*), the concentrated part 602 is drawn so as to be formed in the inclination direction of the injection hole 601, though this position is adjustable. The position of the spray concentrated part 602, by the swirl force of fuel, the length of the injection hole 601, and the position relationship between the injection hole 601 and the swirl chamber 605, can change the position in the hollow conical spray 603. Even when the fuel injection valve as shown in FIG. 6 is used in the internal combustion engine of an combustion chamber direct injection type, to improve the combustion stability, the spray concentrated part 602 is desirably directed toward the ignition plug.

As shown in FIGS. 5 and 6, even in the swirl type fuel injection valve capable of forming a crescent spray concentrated part, similarly to the fuel injection valve shown in FIG. 2, the position of the spray concentrated part is rotated depending on the pressure and density of ambient gas.

According to the fuel injection valve as shown in FIGS. 5 and 6, the spray concentrated part can be made comparatively wide, so that to a phenomenon that the spray concentrated part is rotated in a pressurized atmosphere, the spray concentrated part can be made insensitive. However, even in spray as shown in FIGS. 5 and 6, a phenomenon that the spray concentrated part is rotated in the rotational direction in a pressurized atmosphere occurs, so that when the spray concentrated part under the ambient pressure is directed toward the ignition plug, the combustion stability is not always best.

Therefore, by adjusting the mounting rotation amount with the internal combustion engine as described in the present invention, the combustion stability can be improved.

To perform the aforementioned mounting of the fuel injection valve to the internal combustion engine, in the mounting of the fuel injection valve, it is desirable to install a setting means for setting the rotational direction.

Figure 7:
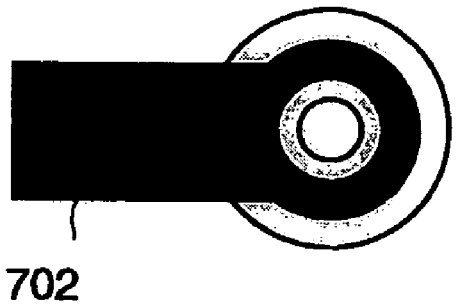
FIG. 7 is a top view and a front view of the fuel injection valve having a positioning mark in the rotational direction of the fuel injection valve.
Figure 7:
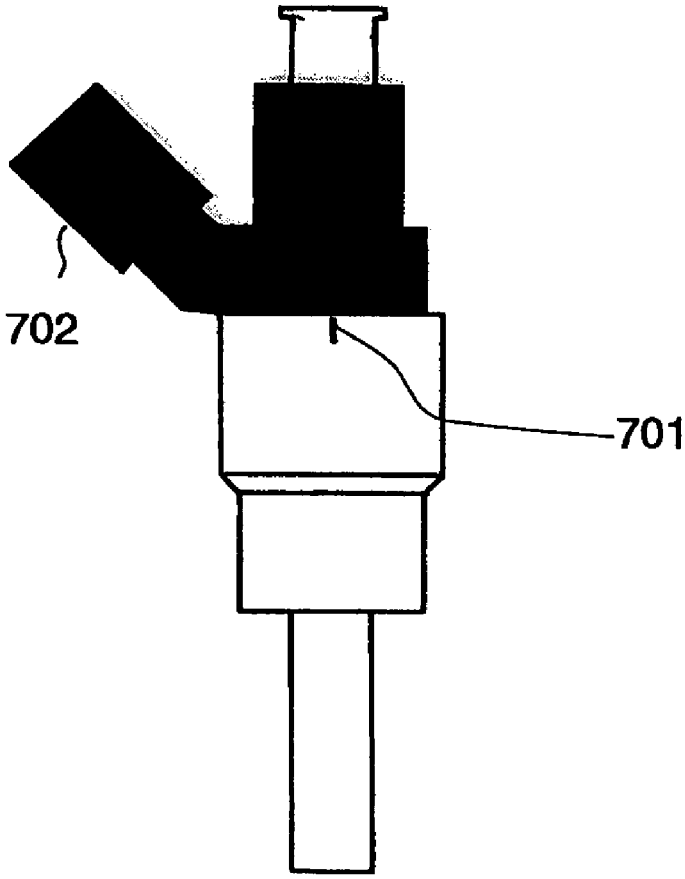

FIG. 7 is composed of a top view (a) and a front view (b) showing the mounting positions of a fuel injection valve to an internal combustion engine showing respectively the rotation positions on the mounting portion of the fuel injection valve and internal combustion engine. In FIG. 7, outside the fuel injection valve, a mark 701 indicating the rotation position is installed, and also on the mounting portion of the internal combustion engine, the similar mark is installed, and at the time of mounting, these marks are adjusted to each other, thus precise mounting can be realized. The mark 701, when the fuel injection valve is mounted on the internal combustion engine, may be installed so that the fuel injection valve is rotated and mounted in the opposite direction of the combustion rotational direction instead of the direction in which the spray concentrated part in the atmosphere under the atmospheric pressure is directed toward the ignition plug.

Figure 8:
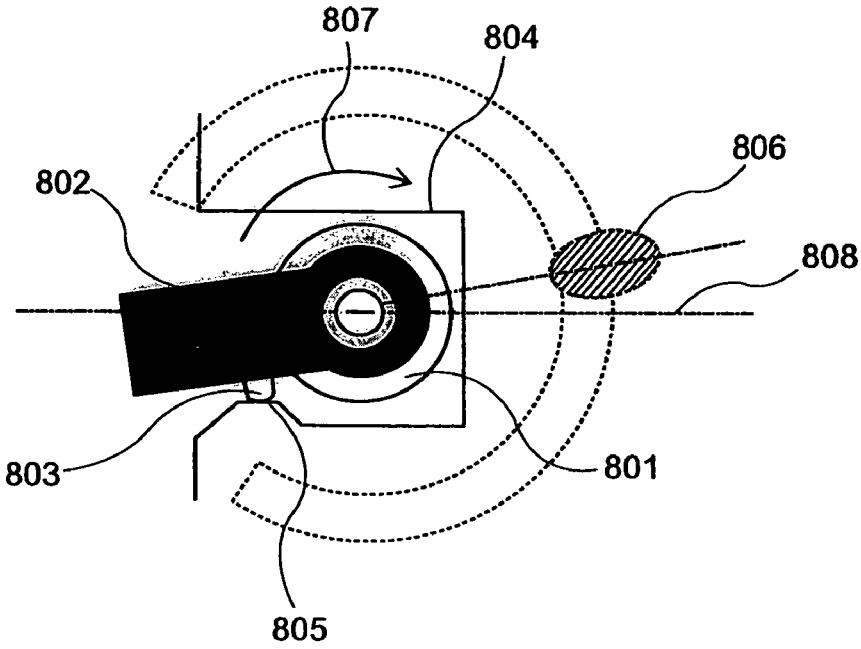
FIG. 8 is a top view showing the mounting state of the fuel injection valve having a positioning pin in the rotational direction outside the fuel injection valve on the internal combustion engine.

FIG. 8 is a top view showing the mounting state of the means for specifying the rotational direction to the internal combustion engine of the fuel injection valve. As shown in FIG. 8, outside a fuel injection valve 801, a pin 803 is installed. In FIG. 8, on a resin mold portion 802 formed together with a connector, the pin 803 is installed. On a mounting portion 804 of the cylinder head of the internal combustion engine on the fuel injection valve, a striking portion 805 of the pin 803 is installed, and when mounting the fuel injection valve 801 on the internal combustion engine, it is mounted so that the pin 803 and the pin receiver 805 make contact with each other, thus the fuel injection valve 801 can be mounted in the rotational direction as preset. The pin receiver 805 may be installed on the mounting portion of the fuel injection valve on the internal combustion engine not only as a projection but also as a plane or a concavity.

At this time, the mounting rotation amount of the fuel injection valve 801 may be adjusted by the projection length of the pin 803. With respect to the pin 803, at the manufacturing step of the fuel injection valve, for example, a plurality of long and short pins are prepared and on the basis of the measured value of the position of the concentrated part of spray injected from the fuel injection valve in the rotational direction, may be selectively fit into the hole formed in the resin mold portion 802. Or, the pin 803, on the basis of the measured value of the position of the concentrated part of spray injected from the fuel injection valve in the rotational direction, may be ground. Further, when the pin 803 is ground and used like this, if the pin 803 is formed integrally with the resin mold portion 802, the number of parts can be reduced and the manufacturing cost can be suppressed.

The projection length of the pin 803, when the fuel injection valve 801 is mounted on the internal combustion engine, may be installed so that the fuel injection valve is rotated and mounted in the opposite direction of the rotational direction of the fuel flow 807 instead of the direction in which the spray concentrated part in the atmosphere under the atmospheric pressure is directed toward the ignition plug. In FIG. 8, the ignition plug is arranged on the line in a direction 808 of the ignition plug.

Further, due to variations in the manufacture of the fuel injection valve, the position of the spray concentrated part in the rotational direction may be varied. However, when specifying the mounting on the internal combustion engine by the structure shown in FIG. 8, for a case that fuel is injected in the atmosphere under the atmospheric pressure at the manufacturing step of the fuel injection valve, the position of a spray concentrated part 806 is measured, and the length of the pin 803 is adjusted according to the measured value, thus the spray concentrated part is correctly directed toward the ignition plug, and variations in the combustion stability due to variations in the manufacture can be suppressed.

Figure 9:
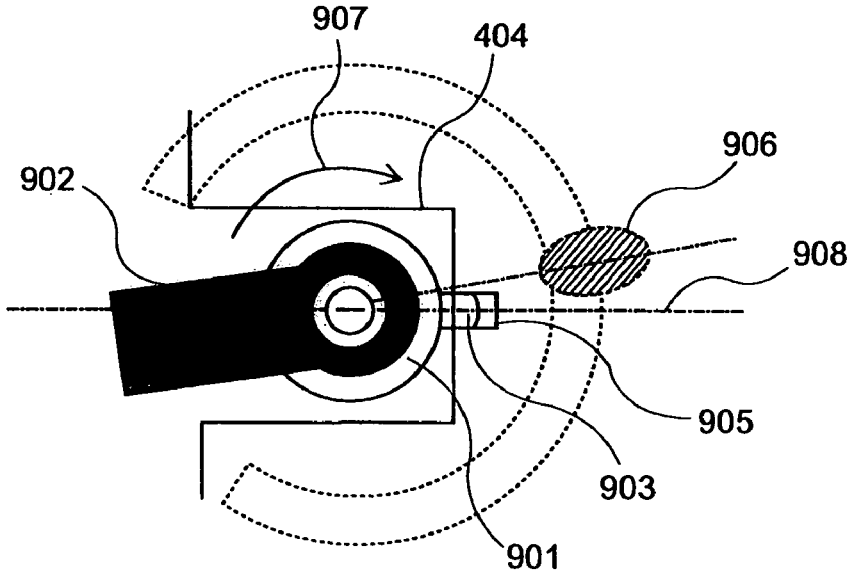
FIG. 9 is a top view showing the mounting state of the fuel injection valve having a positioning pin in the rotational direction outside the fuel injection valve on the internal combustion engine.

FIG. 9 is a top view showing the mounting state of a fuel injection valve on an internal combustion engine showing another example that a pin is installed outside the fuel injection valve. FIG. 9 shows an example that a pin 903 is installed on the cylindrical peripheral surface of a fuel injection valve 901. When the pin 903 is installed, the position of the pin 903 on the cylindrical structure of the fuel injection valve 901 is adjusted. At the manufacturing step, on the basis of the measured value of the position of the concentrated part of spray injected from the fuel injection valve 901 in the rotational direction, the position of the pin 903 to be installed is decided, and a hole is bored on the peripheral surface of the fuel injection valve 901, and the pin 903 is fit into it. At this time, at a mounting portion 904 of the fuel injection valve on the internal combustion engine, as shown in FIG. 9, a hollow 905 which is a pin receiver is formed. When the fuel injection valve is mounted, it is mounted so that the pin 903 is fit into the hollow 905, thus when the fuel injection valve is mounted on the internal combustion engine, the fuel injection valve may be installed so that the fuel injection valve is rotated and mounted in the opposite direction of the rotational direction of the fuel flow 907 instead of the direction in which the spray concentrated part in the atmosphere under the atmospheric pressure is directed toward the ignition plug. In FIG. 9, the ignition plug is arranged on the line in a direction 908 of the ignition plug.

As mentioned above, according to this embodiment, in the use state of the internal combustion engine, the spray concentrated position can be correctly directed toward the ignition plug, so that an internal combustion engine of a combustion chamber direct injection type having high combustion stability can be provided.

Figure 10:
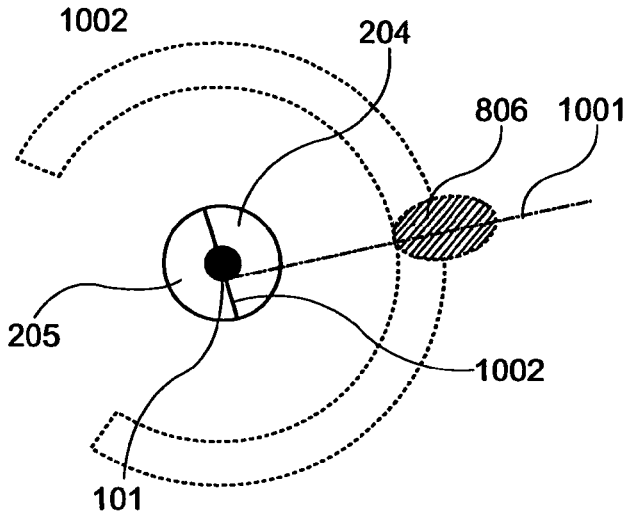
FIG. 10 is a drawing showing the relationship between the shape of the front end of the nozzle of the fuel injection valve having the positioning pin in the mounting rotational direction shown in FIGS. 8 and 9 and spray.

FIG. 10 is a drawing showing the relationship between the shape of the front end of the nozzle of the fuel injection valve having the positioning pin in the mounting rotational direction shown in FIGS. 8 and 9 and spray in an example that for the fuel injection valve, a nozzle having a level difference at its front end as shown in FIG. 2 is used. In FIG. 10, to show the relationship between the nozzle and spray, the size of the nozzle is drawn exaggeratingly.

In FIG. 10, the end face 205 of the nozzle, as shown in FIG. 2, is a convex end face outside the nozzle and the end face 204 is a concave end face outside the nozzle. The boundary between the end face 204 and the end face 205 is given a level difference 1002 and it is fit into the injection hole 101.

In spray injected from such a nozzle, the spray concentrated part 806 is generated. A direction 1001 in which the spray concentrated part 806 is generated is a tangential direction of the injection hole 101 at the position where the edge of the injection hole 101 and the level different portion 1002 intersect.

Therefore, when installing, on a fuel injection valve having a level difference at the front end of the nozzle as shown in FIG. 2, a positioning means in the rotational direction of the fuel injection valve shown in FIGS. 8 and 9, assuming the direction in which a spray concentrated part is generated as the tangential direction of the injection hole 101 at the position where the level different portion 1002 and the edge of the injection hole 101 intersect, it is desirable to install a positioning means.

Figure 11:
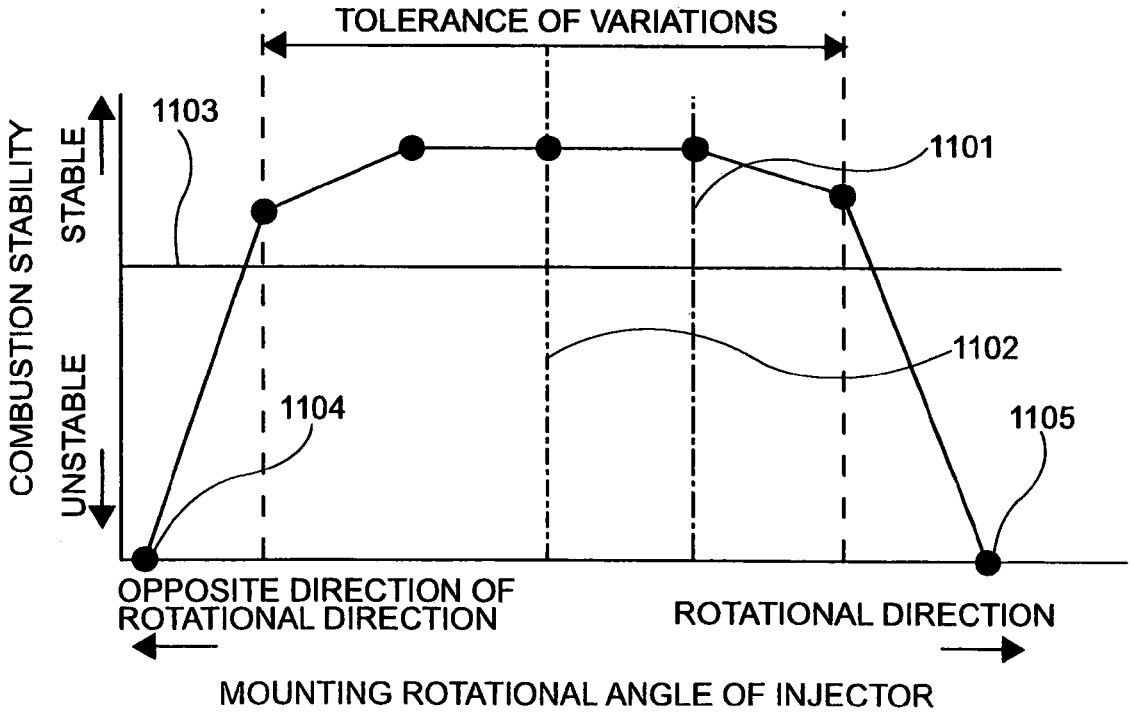
FIG. 11 is a graph showing the situation that the combustion stability when the fuel injection valve relating to the present invention is attached to the internal combustion engine is improved.

FIG. 11 is a graph showing the situation that when the fuel injection valve as shown in FIG. 2 is attached to the internal combustion engine as shown in FIG. 4, the combustion stability is improved by the present invention. The axis of abscissa indicates a mounting angle of the injector in the rotational direction and the rightward direction is the rotational direction of fuel. Further, a position 1101 of 0° on the axis of abscissa is the position toward which the fuel concentrated part when the fuel injection valve injects fuel into an atmosphere under the atmospheric pressure is directed. Further, the combustion stability indicated by the axis of ordinate indicates the ranges of stable combustion of the injection time and ignition time when the internal combustion engine is operated by shifting respectively the fuel injection time and ignition time and the upper part of the graph indicates that the stable range is wide. Further, a line 1103 on the graph indicates the lower limit of combustion stability.

As shown in FIG. 11, when the mounting angle of the injector in the rotational angle is shifted, even if the injection time and ignition time are shifted like a point 1104 and a point 1105, stable combustion cannot be realized. On the other hand, the combustion stability is optimized, as shown by a line 1102, when the fuel injection valve is rotated and mounted in an about 5° arc in the opposite direction of the rotational direction of fuel.

When the mounting position in the rotational direction is set at the position 0° as indicated by the line 1101, the tolerance of fuel in the rotational direction of fuel is narrowed. When the fuel injection valve is attached to the internal combustion engine, even if the positioning pin as shown in FIGS. 8 and 9 is used, mounting variations are caused. Therefore, when the mounting position in the rotational direction is set at the position as indicated by the line 1101, the tolerance of variations of fuel in the rotational direction is narrowed and depending on variations in the mounting position in the rotational direction, no stable combustion can be obtained.

According to the present invention, the mounting position of the fuel injection valve in the rotational direction is shifted to the position in the opposite direction of the rotational direction as indicated by the line 1102, so that the tolerance of variations can be increased. As a result, even if there are variations in the fuel injection valve and variations in the mounting position in the rotational direction, sufficient combustion stability can be obtained.

What is claimed is:

1. A fuel injection method of an internal combustion engine for injecting fuel so as to generate a part of high spray concentration and a part of low spray concentration on a cross section of spray by giving swirling force to said fuel from an injection hole at a front end of a fuel injection valve, comprising the step of setting a reference indicating a position of an axis of said fuel injection valve indicating an injection direction of said part of high spray concentration in a rotational direction when said fuel is injected into an atmosphere under atmospheric pressure.

2. A fuel injection method of an internal combustion engine according to claim 1, wherein said reference of said position in said rotational direction is set so that said part of high spray concentration under pressure higher than said atmospheric pressure is directed toward said ignition plug.

3. A fuel injection method of an internal combustion engine according to claim 2, wherein said reference indicating said position in said rotational direction is set at a position when said injection direction of said part of high spray concentration under said atmospheric pressure is rotated in an opposite direction of said rotation direction of said axis of said fuel injection valve instead of a position of said ignition plug.

4. A fuel injection method of an internal combustion engine according to any of claims 1 to 3, wherein a rotation amount of said axis of said fuel injection valve indicating said injection direction in which said part of high spray concentration under pressure higher than said atmospheric pressure moves toward said ignition plug, on the basis of at least one operation condition relating to a engine speed of said internal combustion engine, load, exhaust gas recirculation amount, and fuel injection time, is set with reference to said rotation amount indicating said injection direction of said part of high spray concentration under said atmospheric pressure.

5. A fuel injection method of an internal combustion engine according to any of claims 1 to 4, wherein said spray under said atmospheric pressure has a cross section in a hollow conical shape.

6. A fuel injection method of an internal combustion engine according to any of claims 1 to 5, wherein said spray under said atmospheric pressure has a cross section in a hollow conical shape eccentric to a central axis of said injection hole.

7. A fuel injection method of an internal combustion engine according to claim 4, wherein said spray under said atmospheric pressure has a cross section in a hollow conical shape.

8. A fuel injection method of an internal combustion engine according to claim 4, wherein said spray under said atmospheric pressure has a cross section in a hollow conical shape eccentric to a central axis of said injection hole.

9. A fuel injection method of an internal combustion engine according to claim 5, wherein said spray under said atmospheric pressure has a cross section in a hollow conical shape eccentric to a central axis of said injection hole.

10. A fuel injection method of an internal combustion engine according to claim 7, wherein said spray under said atmospheric pressure has a cross section in a hollow conical shape eccentric to a central axis of said injection hole.

11. A fuel injection valve of an internal combustion engine comprising a fuel injection valve having an injection hole for injecting fuel and swirling force giving means for giving swirling force to said fuel for injecting said fuel from said injection hole so as to generate a part of high spray concentration and a part of low spray concentration under atmospheric pressure, wherein said fuel injection valve has positioning means indicating a position of a axis of said fuel injection valve attached to said internal combustion engine in a rotational direction and said positioning means, so as to position said part of high spray concentration in an injection direction under said atmospheric pressure, is a set position with reference to said position of said part of high spray concentration under said atmospheric pressure in said rotational direction of said axis of said fuel injection valve in said injection direction.

12. A fuel injection valve of an internal combustion engine according to claim 11, wherein said injection direction of said part of high spray concentration under said atmospheric pressure is set at a position when said injection direction rotates in an opposite direction of said rotational direction of said axis of said fuel injection valve instead of a position of said ignition plug, thus said reference of said position in said rotational direction is set so that said part of high spray concentration under pressure higher than said atmospheric pressure is directed toward said ignition plug.

13. A fuel injection valve of an internal combustion engine according to claim 11 or 12, wherein said rotation amount of said axis of said fuel injection valve indicating said injection direction in which said part of high spray concentration under pressure higher than said atmospheric pressure moves toward said ignition plug, on the basis of at least one operation condition relating to a engine speed of said internal combustion engine, load, exhaust gas recirculation amount, and fuel injection time, is set with reference to said rotation amount indicating said injection direction of said part of high spray concentration under said atmospheric pressure.

14. A fuel injection valve of an internal combustion engine according to any of claims 11 to 13, wherein said positioning means is a mark or a pin for said positioning.

15. A fuel injection valve of an internal combustion engine according to claim 14, wherein said pin changes a length of the same, thus said rotation amount is set.

16. A fuel injection valve of an internal combustion engine according to claim 13, wherein said positioning means is a mark or a pin for said positioning.

17. A fuel injection valve of an internal combustion engine according to claim 16, wherein said pin changes a length of the same, thus said rotation amount is set.

18. An internal combustion engine including a fuel injection valve having an injection hole for injecting fuel and swirling force giving means for giving swirling force to said fuel and loading a fuel injection valve for injecting said fuel from said injection hole so as to generate a part of high spray concentration and a part of low spray concentration under atmospheric pressure, wherein said fuel injection valve and said internal combustion engine respectively have positioning means indicating a mounting position and said positioning means between said fuel injection valve and said internal combustion engine is set as a reference indicating a position of said axis of said fuel injection valve indicating said injection direction of said part of high spray concentration under said atmospheric pressure in said rotational direction.

19. An internal combustion engine according to claim 18, wherein said reference indicating said position of said axis of said fuel injection valve indicating said injection direction of said part of high spray concentration under said atmospheric pressure in said rotational direction is set so that said injection direction of said part of high spray concentration under said atmospheric pressure is directed toward a position when said injection direction is rotated in an opposite direction of said rotation direction of said axis of said fuel injection valve instead of a position of said ignition plug.

20. An internal combustion engine according to claim 18 or 19, wherein said rotation amount of said axis of said fuel injection valve indicating said injection direction in which said part of high spray concentration under pressure higher than said atmospheric pressure moves toward said ignition plug, on the basis of at least one operation condition relating to a engine speed of said internal combustion engine, load, exhaust gas recirculation amount, and fuel injection time, is set with reference to said rotation amount indicating said injection direction of said part of high spray concentration under said atmospheric pressure.

* * * * *